US007540929B2

(12) United States Patent
Demetriou et al.

(10) Patent No.: US 7,540,929 B2
(45) Date of Patent: Jun. 2, 2009

(54) METALLIC GLASS ALLOYS OF PALLADIUM, COPPER, COBALT, AND PHOSPHORUS

(75) Inventors: Marios D. Demetriou, Los Angeles, CA (US); John S. Harmon, Pasadena, CA (US); William L. Johnson, Pasadena, CA (US)

(73) Assignee: California Institute of Technology, Pasadena, CA (US)

( * ) Notice: Subject to any disclaimer, the term of this patent is extended or adjusted under 35 U.S.C. 154(b) by 140 days.

(21) Appl. No.: 11/710,188

(22) Filed: Feb. 23, 2007

(65) Prior Publication Data

US 2008/0135136 A1 Jun. 12, 2008

Related U.S. Application Data

(60) Provisional application No. 60/776,653, filed on Feb. 24, 2006.

(51) Int. Cl.
*C22C 45/00* (2006.01)

(52) U.S. Cl. ..... 148/403; 420/464

(58) Field of Classification Search ..... None
See application file for complete search history.

(56) References Cited

U.S. PATENT DOCUMENTS

| | | | | |
|---|---|---|---|---|
| 5,288,344 | A | 2/1994 | Peker et al. | |
| 5,368,659 | A | 11/1994 | Peker et al. | |
| 5,711,363 | A | 1/1998 | Scruggs et al. | |
| 6,623,566 | B1 * | 9/2003 | Senkov et al. | 148/121 |
| 2006/0124209 | A1 | 6/2006 | Schroers et al. | |

FOREIGN PATENT DOCUMENTS

WO WO-2004/059019 A1 * 7/2004

OTHER PUBLICATIONS

Liu, Li, et al., "Formation Of Bulk Pd-Cu-Si-P Glass With Good Mechanical Properties", *Materials Transactions*, vol. 46, No. 2. (2005),376-378.

Schroers, Jan, et al., "Highly Processable Bulk Metallic Glass-Forming Alloys In The Pt-Co-Ni-Cu-P System", *Applied Physics Letter*, (May 3, 2004),3 pages.

Takenaka, Kana , et al., "New Pd-Based Bulk Glassy Alloys With High Glass-Forming Ability And Large Supercooled Liquid Region", *Materials Transactions*, vol. 46, No. 7, (2005),1720-1724.

* cited by examiner

*Primary Examiner*—George Wyszomierski
(74) *Attorney, Agent, or Firm*—Seth Z. Kalson

(57) ABSTRACT

Metallic glass alloys of palladium, copper, cobalt, and phosphorus, that are bulk-solidifying having an amorphous structure. Other embodiments are described and claimed.

8 Claims, 2 Drawing Sheets

METALLIC GLASS ALLOYS OF PALLADIUM, COPPER, COBALT, AND PHOSPHORUS

This application claims the benefit of U.S. Provisional Application No. 60/776,653, filed 24 Feb. 2006, and is incorporated herein by reference.

FIELD

Embodiments of the present invention related to metallic alloys, and more particularly, to metallic glass alloys.

BACKGROUND

Metallic glass alloys are amorphous alloys. Because amorphous alloys do not have long range ordered structures, they do not share some of the problems associated with ordinary metals having a single crystalline structure, or having a polycrystalline structure with grains and grain boundaries. As a result, metallic glass alloys have been made with various desirable properties, such as strength, elasticity, corrosion resistance, and low surface friction, to name just a few examples.

Historically, rapid cooling was required to bring about the amorphous structure as an alloy was cooled. As a result, because heat was needed to be extracted quickly, only relatively small-dimensioned products, such as ribbons or sheets, for example, were produced. Over the years, alloys were discovered that do not require such rapid cooling rates, so that casting methods may be employed to manufacture metallic glass alloys having larger-sized dimensions, such as having structures with thick layers over 1 mm. Such alloys are sometimes referred to as bulk-solidifying, or bulk, amorphous metallic alloys, and have found applications in diverse products and industries, such as the aerospace industry, sporting goods, consumer electronics, and medical devices and instruments. In medical applications, particularly in medical implants, low toxicity is of course desirable.

The bulk-solidifying amorphous alloys system of Pd—Cu—Ni—P is currently regarded as among the best bulk-glass forming metallic systems in terms of having the slowest cooling rate required to form a glass, or alternatively, in terms of the largest bulk object that may be solidified having an amorphous structure. The presence of Ni, however, hinders utilization of this alloy for biomedical implant applications, as Ni is considered toxic for biomedical use.

There has been recent work in substituting bio-compatible elements for Ni in the Pd—Cu—Ni—P alloys without significantly degrading its glass-forming ability. Two recent efforts toward this end involve substituting Pt or Si for Ni. Pt may be regarded as an effective substitute for Ni in the Pd—Cu—Ni—P system because it contributes to maintaining the glass-forming ability. However, its high market price contributes to a large increase in the cost of the resulting amorphous alloy, thereby making it less affordable for applications requiring large volumes of material. Si, on the other hand, is an inexpensive element and may contribute to a decrease in the cost of the resulting amorphous alloy. However, substitution of Si for Ni has so far not led to very practical amorphous alloys in terms of glass-forming ability.

DESCRIPTION OF EMBODIMENTS

Figure 1:
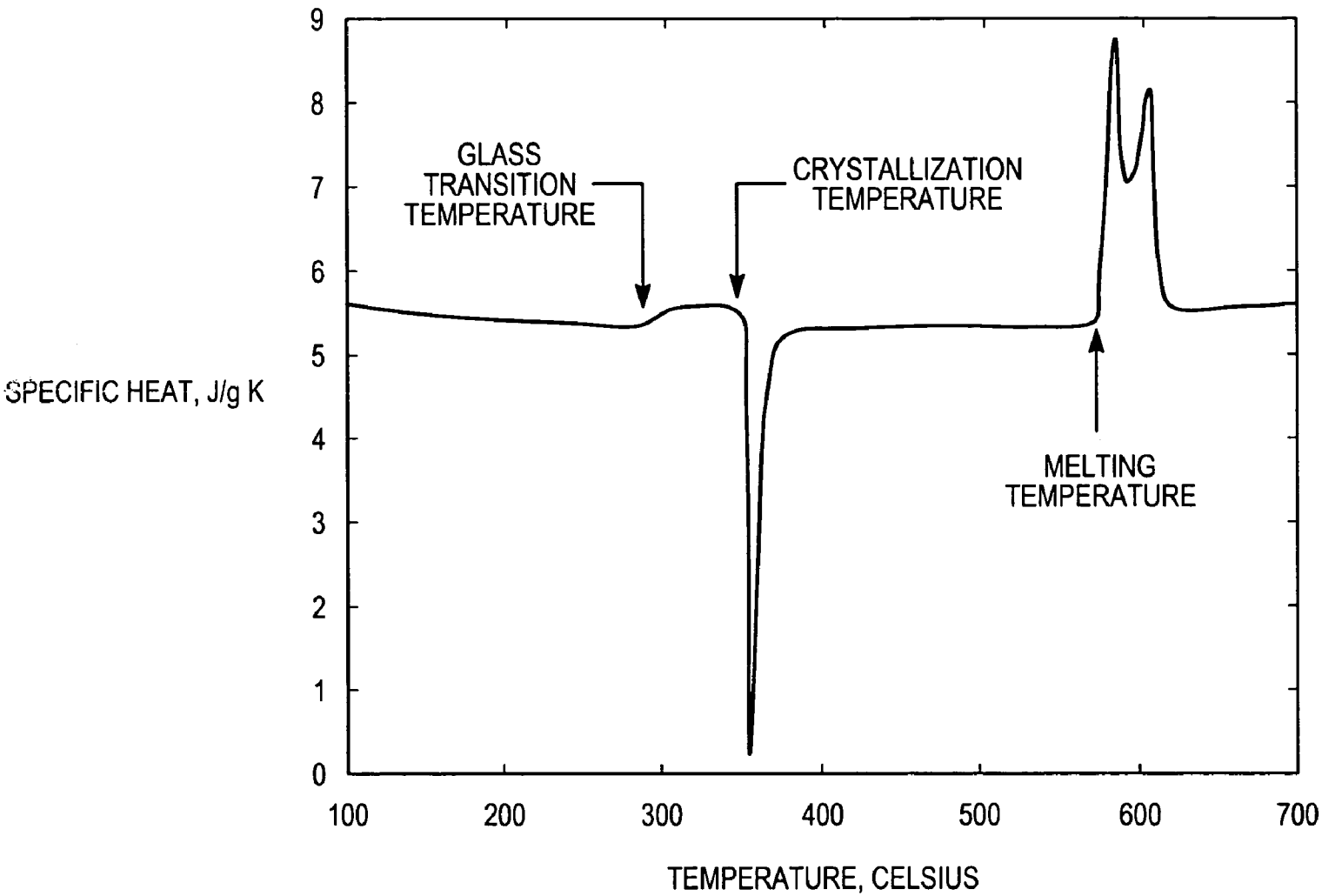
FIG. 1 is a differential scanning colorimetry curve for an embodiment of the present invention.

In the description that follows, the scope of the term "some embodiments" is not to be so limited as to mean more than one embodiment, but rather, the scope may include one embodiment, more than one embodiment, or perhaps all embodiments.

Embodiments of the present invention are based on the quaternary Pd—Cu—Co—P system, and the extensions of this quaternary system to higher order alloys by the addition of one or more alloying elements. Unlike Ni, Co is regarded as bio-compatible for biomedical use. Co and Ni have similar thermodynamic reactions with Pd. This suggests that Co may be an effective substitute for Ni in the Pd—Cu—Ni—P system in relation to its glass-forming ability. Furthermore, Co is a relatively inexpensive element, and it use may help to bring down the cost of embodiment alloys.

For some embodiments, one or more of the following atomic percentages may be used: the Pd content may be from about 20 to about 70 atomic percentage, the Cu content may be from about 10 to about 50 atomic percentage, the Co content may be from about 1 to about 20 atomic percentage, or the P content may be from about 10 to about 30 atomic percentage. Example embodiments include, but are not limited to, $Pd_{34}Cu_{42}Co_4P_{20}$; $Pd_{36}Cu_{40}Co_4P_{20}$; $Pd_{37}Cu_{34}Co_4P_{25}$; $Pd_{38}Cu_{38}Co_4P_{20}$; $Pd_{40}Cu_{39}Co_1P_{20}$; $Pd_{40}Cu_{38}Co_2P_{20}$; $Pd_{40}Cu_{35}Co_5P_{20}$; $Pd_{40}Cu_{36}Co_4P_{20}$; $Pd_{40}Cu_{38}Co_3P_{19}$; $Pd_{41}Cu_{25}Co_{15}P_{18}$; $Pd_{42}Cu_{38}Co_4P_{16}$; $Pd_{41}Cu_{25}Co_{15}P_{18}$; $Pd_{42}Cu_{38}Co_4P_{16}$; $Pd_{42}Cu_{34}Co_8P_{16}$; $Pd_{43}Cu_7Co_{10}P_{20}$; $Pd_{44}Cu_{39}Co_4P_{13}$; $Pd_{45}Cu_{42}Co_3P_{10}$; $Pd_{45}Cu_{36}Co_4P_{15}$; $Pd_{45}Cu_{40}Co_5P_{10}$; $Pd_{46}Cu_{45}Co_1P_8$; $Pd_{61}Cu_{21}Co_2P_{16}$; $Pd_{42}Cu_{34}Co_4P_{20}$; $Pd_{44}Cu_{32}Co_4P_{20}$; and $Pd_{46}Cu_{30}Co_4P_{20}$, where the subscripts denote atomic percentage.

Some example embodiments are also listed in Table 1, along with results from differential scanning colorimetry. In Table 1, each entry gives the atomic percentage of each element in an example composition, and Table 1 also gives the measured glass transition temperature, crystallization temperature, and melting temperature for each listed composition unless not detected. When a glass transition temperature or a melting temperature was not detected, a question mark "?" appears as an entry. In some cases, two glass transition temperatures or two crystallization temperatures are listed for a given entry, because either the composition separated into two glasses, or two glasses were already present from the beginning.

TABLE 1

Example Embodiment Alloys and Measured Temperatures

| Pd | Cu | Co | P | Glass Transition Temperature (Celsius) | Crystallization Temperature (Celsius) | Melting Temperature (Celsius) |
|---|---|---|---|---|---|---|
| 43 | 27 | 10 | 20 | 313 | 348.3 | 563 |
| 39.99 | 34.92 | 4.99 | 20.16 | 281.8 | 339.3 | 568.5 |
| 40.74 | 25.53 | 15.3 | 18.4 | ? | 351.2/469.9 | 516 |
| 42.03 | 34.15 | 7.88 | 15.94 | 293 | 325.4 | 568.5 |
| 45.06 | 42.16 | 2.81 | 9.97 | 280.1 | 345.2 | 567.2 |
| 46.26 | 45.11 | 1.12 | 7.47 | 267.7 | 307.6 | 567.1 |
| 39.79 | 38.79 | 0.99 | 20.4 | 263 | 322.5 | 587.5 |
| 39.87 | 37.87 | 2 | 20.25 | 271 | 322.4 | 597.2 |
| 40.69 | 37.64 | 3.05 | 18.61 | 276.3 | 332.4 | 564.4 |
| 40.02 | 36.02 | 4 | 19.96 | 273.3 | 335.4 | 564.9 |
| 45 | 42 | 3 | 10 | ? | 477.4 | 620 |
| 45 | 36 | 4 | 15 | ? | 341.6/449.8 | 567 |
| 45.1 | 40.6 | 4.5 | 9.8 | ? | 496.3 | 619.7 |
| 37.4 | 33.7 | 3.7 | 25.2 | ? | 353.2 | 577.6 |
| 43.4 | 39.1 | 4.3 | 13.2 | ? | 456.8 | 626.6 |
| 41.8 | 37.6 | 4.2 | 16.4 | 298.3 | 343.8 | 569.5 |
| 61.37 | 20.78 | 1.99 | 15.86 | 354 | 385.7 | 726.5 |
| 45.1 | 42.1 | 3 | 9.8 | 294.3 | 349/476.1 | 629.5 |

TABLE 1-continued

Example Embodiment Alloys and Measured Temperatures

| Pd | Cu | Co | P | Glass Transition Temperature (Celsius) | Crystal-lization Temperature (Celsius) | Melting Temperature (Celsius) |
|---|---|---|---|---|---|---|
| 44.48 | 32.35 | 4.05 | 19.11 | 285.6 | 354.1 | 572 |
| 46.7 | 30.5 | 4.1 | 18.7 | 295.8 | 362.2 | 570 |
| 37.79 | 37.8 | 3.98 | 20.44 | 266.9 | 326.4 | ? |
| 36.21 | 40.24 | 4.04 | 19.5 | 264.2 | 316.6 | ? |
| 33.9 | 41.88 | 4 | 20.2 | 261.1 | 310.8 | ? |
| 44.6 | 30.7 | 3.98 | 20.6 | 290.3 | 334 | 572.1 |
| 42.83 | 32.87 | 3.98 | 20.31 | 287.6 | 325.8 | 570.6 |
| 46.54 | 33.85 | 4.23 | 15.38 | 311.6 | 350.1 | 571 |
| 47.62 | 31.09 | 1.99 | 19.30 | 302.7 | 346.8 | 570 |
| 48.50 | 31.64 | 1.99 | 17.92 | 308.1 | 351.3 | 573 |
| 46.85 | 28.91 | 4 | 20.23 | 297.1 | 362.6 | 574.8 |

An example of a differential scanning colorimetry curve for an embodiment is illustrated in FIG. 1, showing specific heat in units of Joules per gram per Kelvin as a function of temperature in Celsius. The endothermic and exothermic regions are labeled in FIG. 1, illustrating the glass transition temperature, crystallization temperature, and melting temperature. For the particular curve of FIG. 1, the sample was $Pd_{44.48}Cu_{32.35}Co_{4.05}P_{19.11}$, where the subscripts are in atomic percentage.

Embodiments may have additional elements, for example, to improve the ease of casting the resulting alloys into larger bulk objects, to increase the ability to process the alloys, or to improve various physical properties of the alloys. For some embodiments, such added elements may include, but are not limited to, Si, B, or both. Some embodiments may include, but are not limited to, Pt, Cr, Ir, and Au, which may be used as fractional substitutes of Pd. For some embodiments, such added elements may include, but are not limited to, Ge, Ga, Al, As, Sn, and Sb, which may be used as fractional substitutes of P. Other alloying elements may also be added. For example, for some embodiments, it is expected that other alloying elements may, in general, be added without significantly affecting the ability to process the resulting alloy, provided their total amount is limited to less than 2 atomic percent.

Figure 2:
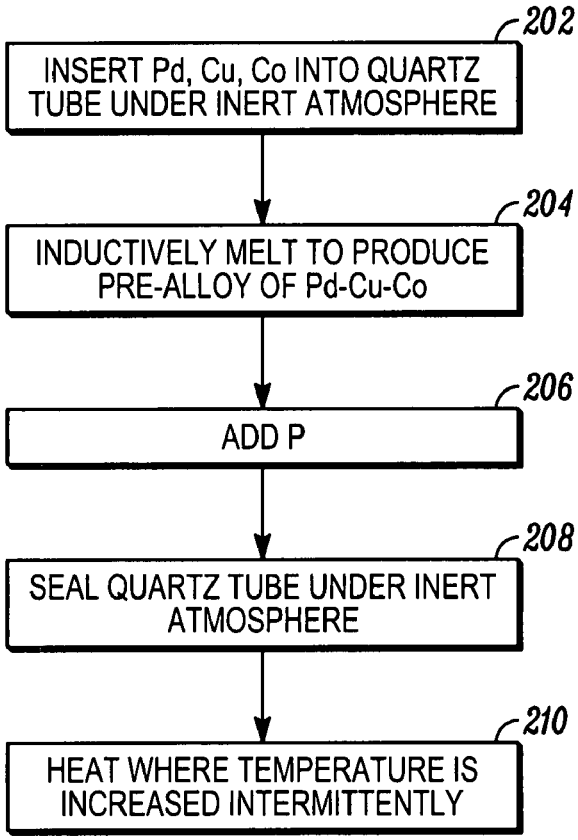
FIG. 2 illustrates a method for preparing a Pd—Cu—Co—P alloy.

A method for mixing Pd, Cu, Co, and P alloys for producing Pd—Cu—Co—P alloys according to an embodiment of the present invention is illustrated in FIG. 2. Block 202 indicates that the elements Pd, Cu, and Co are inserted into a quartz tube under an inert atmosphere. For example, Ar or He at one atmospheric pressure may be utilized as an inert atmosphere. Block 204 indicates that these elements are inductively melted to produce a pre-alloy of Pd—Cu—Co. Block 206 indicates that P is added to the pre-alloy, block 208 indicates that the quartz tube is sealed under an inert atmosphere, and block 210 indicates that heat is added by increasing the temperature intermittently. Increasing the temperature intermittently helps accommodate the rising gas pressure of the subliming phosphorous.

For some embodiment methods, a container other than a quartz tube may be used. For example, a container comprising a material that can withstand a higher hydrostatic pressure than a quartz tube may be used so that the temperature may not be increased intermittently as indicated in block 210. As an example of an embodiment method when quartz was used, the temperature was increased to room temperature to about 400 Celsius at a rate of 20 Celsius per minute, and then was raised from 400 Celsius to 750 Celsius at a rate of 0.1 Celsius per minute.

In another embodiment method, Pd and P may be alloyed first in an arc furnace, and then Cu and Co may be added to the Pd—P pre-alloy by inductively melting Cu and Co in a quartz tube under an inert atmosphere. In yet another embodiment method, commercially available metal phosphates such as Pd—P, Cu—P, or Co—P may be utilized as a starting pre-alloy, and the remaining metals may be added to the pre-alloy by inductively melting in a quartz tube under an inert atmosphere.

Figure 3:
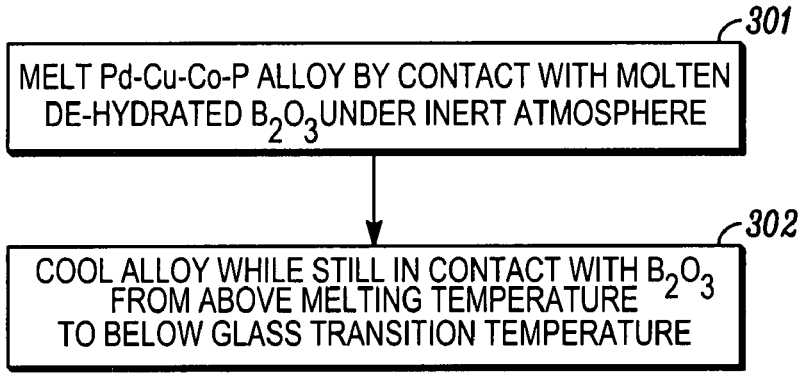
FIG. 3 illustrates a method for preparing the Pd—Cu—Co—P alloy of the method of FIG. 2 into a bulk-solidifying metallic glass alloy according to an embodiment of the present invention.

Using the resulting alloy provided by the method of FIG. 2, a method for producing bulk objects having at least 50%, by volume, of amorphous Pd—Cu—Co—P alloy according to an embodiment of the present invention is illustrated in FIG. 3. Block 301 indicates that the Pd—Cu—Co—P alloy is melted and placed in contact with molten dehydrated $B_2O_3$ under an inert atmosphere. De-hydrated $B_2O_3$ is used as a non-reactive fluxing agent, and other materials may be used for this purpose. Heat may be applied by inductive heating. For some embodiment methods, the melting temperature may be in the range of 550 to 750 Celsius. Block 302 indicates that while the alloy is still in contact with the de-hydrated $B_2O_3$, the alloy is cooled from above its melting temperature to below its glass transition temperature at a rate to prevent the formation of more than a 50% crystalline phase. For some embodiments, a Cu mold casting may be used in block 302. The cooling rate may depend upon the type and thickness of the mold casting, as well as other variables.

Various modifications may be made to the disclosed embodiments without departing from the scope of the invention as claimed below.

What is claimed is:

1. An alloy comprising:
Palladium;
Copper;
Cobalt; and
Phosphorous;
wherein the alloy has an amorphous structure; wherein the alloy has a Palladium content of 20 to 70 atomic percentage, wherein the alloy is substantially free of Platinum.

2. The alloy as set forth in claim 1, wherein the alloy has a Copper content of 10 to 50 atomic percentage.

3. The alloy as set forth in claim 2, wherein the alloy has a Cobalt content of 1 to 20 atomic percentage.

4. The alloy as set forth in claim 3, wherein the alloy has a Phosphorous content of 10 to 30 atomic percentage.

5. An alloy comprising:
Palladium;
Copper;
Cobalt; and
Phosphorous;
wherein the alloy has an amorphous structure; wherein the alloy has a Cobalt content of 1 to 20 atomic percentage; wherein the alloy has a Palladium content of 20 to 70 atomic percentage, wherein the alloy is substantially free of Platinum.

6. The alloy as set forth in claim 5, wherein the alloy has a Phosphorous content of 10 to 30 atomic percentage.

7. An alloy comprising:
Palladium;
Copper;
Cobalt; and
Phosphorous;
wherein the alloy has an amorphous structure; wherein the alloy has a Phosphorous content of 10 to 30 atomic percentage; wherein the alloy has a Palladium content of 20 to 70 atomic percentage, wherein the alloy is substantially free of Platinum.

8. The alloy as set forth in claim 7, wherein the alloy has a Copper content of 10 to 50 atomic percentage.

* * * * *